US006054550A

United States Patent [19]

Umezawa et al.

[11] Patent Number: 6,054,550

[45] Date of Patent: Apr. 25, 2000

[54] WOUND GOLF BALL

[75] Inventors: Junji Umezawa; Shinichi Kakiuchi; Yasushi Ichikawa, all of Chichibu; Nobuhiko Matsumura; Kunitoshi Ishihara, both of Izumiohtsu, all of Japan

[73] Assignee: Bridgestone Sports Co., Ltd., Tokyo, Japan

[21] Appl. No.: 09/062,767

[22] Filed: Apr. 20, 1998

[30] Foreign Application Priority Data

Apr. 18, 1997 [JP] Japan ..... 9-116449

[51] Int. Cl.[7] ..... A63B 37/12

[52] U.S. Cl. ..... 528/76; 528/83; 473/363; 473/365; 473/374; 473/378

[58] Field of Search ..... 528/76, 83; 473/363, 473/365, 378

[56] References Cited

U.S. PATENT DOCUMENTS

| | | |
|---|---|---|
| 5,792,008 | 8/1998 | Kakiuchi . |
| 5,797,808 | 8/1998 | Hayashi . |

FOREIGN PATENT DOCUMENTS

| | | |
|---|---|---|
| 59-129072 | 7/1984 | Japan . |
| 60-210272 | 10/1985 | Japan . |
| 61-290969 | 12/1986 | Japan . |
| 5-73427 | 10/1993 | Japan . |

*Primary Examiner*—David Buttner
*Attorney, Agent, or Firm*—Sughrue, Mion, Zinn, Macpeak & Seas, PLLC

[57] ABSTRACT

A thread-wound golf ball includes a core having a center ball and a rubber thread layer and a cover. The cover of the ball has a two-layer structure consisting of an inner layer and an outer layer, each made from differing cover stock formulations of thermoplastic polyurethane elastomer.

16 Claims, 1 Drawing Sheet

WOUND GOLF BALL

BACKGROUND OF THE INVENTION

1. Field of the Invention

This invention relates to a thread-wound golf ball comprising a thread-wound core composed of a center ball and a layer of rubber thread thereon, and a cover formed over the core.

2. Prior Art

Thread-wound golf balls are conventionally made by winding highly stretched rubber thread onto a liquid center or a solid center to form a rubber thread layer about the center, and forming a cover of balata rubber or ionomer resin over the rubber thread layer.

Compared with two-piece solid golf balls, wound golf balls are preferred by professional golfers and skilled amateurs for their soft "feel" when hit with a golf club and their excellent spin performance (good spin receptivity). Yet, wound golf balls travel a steeper skying trajectory due to backspin, resulting in less carry than two-piece solid golf balls.

A number of attempts have been made to develop wound golf balls having greater carry. One attempt is to increase the moment of inertia of the golf ball.

The moment of inertia of a golf ball exerts a large influence on such properties during the flight of a golf ball as the trajectory, carry and control of the ball. Increasing the moment of inertia generally serves to lower the attenuation of spin during flight of the ball so that the spin rate is maintained even as the ball passes the peak of its trajectory and descends, making for an elongated trajectory. Moreover, when the ball is putted on a green, a higher moment of inertia increases the straightness of the shot and improves the roll.

Hence, a number of golf balls having large moments of inertia have been proposed (e.g., JP-B 73427/1993, JP-A 129072/1984, and JP-A 210272/1985). More particularly, the moment of inertia is increased by using a cover stock of ionomer resin having blended therein a high specific gravity filler such as white barium sulfate or titanium oxide as disclosed in JP-A 61-290969/1986.

However, because the filled cover stock flows less, the cover stock does not readily penetrate the rubber thread layer in the case of wound golf balls, which sometimes results in a lower durability. In addition, other problems include a decrease in resilience and reduced carry, as well as burring and napping of the cover.

Attempts have also been made in which heavy fillers having a specific gravity of 8 or more such as tungsten are blended into the cover formulation. There are limits to the adjustments that can be made by blending in weight-modifying ingredients. In addition, the resulting cover is not satisfactorily white.

Cover resins have also been the subject of various investigations. Thermosetting polyurethane elastomers are often used as substitutes for balata rubber or ionomer resin because of their relatively low cost and their good feel and scuff resistance (e.g., U.S. Pat. Nos. 4,123,061, 3,989,568, and 5,334,673).

Such thermoset polyurethane elastomers are superior in terms of scuff resistance, which is a shortcoming of soft blends of ionomer resins. However, after the starting materials have been poured, curing reactions and other complex operations must be carried out, making the adaptation of this technology to mass production quite difficult. Moreover, when only aliphatic isocyanate is used in the thermosetting polyurethane elastomer, the curing reaction rate is too slow. The use of some aromatic isocyanate is desirable for speeding up the reaction rate. The use of aromatic isocyanate, however, causes the cover to yellow with time. Even if a white enamel coating is applied to the outside of the ball to hide this, the appearance and color of the ball deteriorate as the urethane cover yellows.

Covers made of thermoplastic polyurethane elastomer have also been investigated (e.g., U.S. Pat. Nos. 3,395,109, 4,248,432 and 4,442,282). Although thermoplastic polyurethane elastomers improve the scuff resistance when the ball is hit with an iron club, as well as the moldability and other properties, there has yet to be obtained a sufficient improvement in flight distance due to an increased moment of inertia. Hence, the development of a golf ball with a thermoplastic polyurethane elastomer cover having even higher performance and quality has been awaited.

On the basis of studies aimed at improving the performance of wound golf balls by enhancing the moment of inertia, the present inventors proposed in U.S. Ser. Nos. 08/841,559 and 08/841,677, which are assigned to the same assignee as the present invention, golf balls with covers in which the primary component is a non-yellowing thermoplastic polyurethane elastomer. Owing to the increased moment of inertia, these wound golf balls offer a longer carry and excellent control, as well as excellent scuff resistance on iron shots, yellowing resistance, and moldability. Even so, there remains a desire for wound golf balls having even higher performance and quality.

SUMMARY OF THE INVENTION

An object of the present invention is to provide a high-performance, high-quality thread-wound golf ball which is not only improved in flight distance due to the increased moment of inertia, but also improved in control, scuff resistance on iron shots, yellowing resistance and moldability.

In the present invention, there is provided a thread-wound golf ball comprising a wound core composed of a center ball and a layer of rubber thread wound onto the center ball and a cover formed over the core with a multilayer structure having an inner layer and an outer layer. Each of the inner cover layer and the outer cover layer is composed primarily of a thermoplastic polyurethane elastomer of an aliphatic and/or alicyclic diisocyanate. The inner cover layer has a melting point of 80 to 110° C. and a thickness of 0.5 to 2.0 mm. The outer cover layer has a Shore D hardness of 40 to 55 and a thickness of 0.5 to 2.0 mm. The cover has an overall thickness of 1.2 to 3.5 mm.

More particularly, the thread-wound golf ball includes a wound core composed of a center ball and a layer of rubber thread wound onto the center ball. The wound core is enclosed with a cover of a multilayer structure having an inner layer and an outer layer. By using a thermoplastic polyurethane elastomer of an aliphatic and/or alicyclic diisocyanate as the main component of the cover resin for each of the inner and outer cover layers, a cover stock having a high specific gravity is obtained. By forming the inner cover layer to a thickness of 0.5 to 2.0 mm with a thermoplastic polyurethane elastomer having a melting point of 80 to 110° C., the outer cover layer to a Shore D hardness of 40 to 55 and a thickness of 0.5 to 2.0 mm, and the overall cover to a total thickness of 1.2 to 3.5 mm, the moment of inertia is effectively increased and optimized, the flight stability is enhanced, a much longer carry is achieved, and the control is improved. Moreover, the thermoplastic polyurethane elastomer used as the cover stock has the advantages that it effectively prevents napping and burring of the ball surface because of excellent scuff resistance on iron shots, it is readily moldable because of its thermoplastic properties, and it also minimizes yellowing of the cover surface over time. Thus a number of long-standing problems in the prior art can be effectively resolved.

More specifically, in a thread-wound golf ball comprising a center ball, rubber thread, and a cover, the present invention gives the cover a two-layer structure composed primarily of aliphatic and/or alicyclic diisocyanate-based thermoplastic polyurethane elastomers. A high-resilience grade of elastomer having excellent scuff resistance is used in the outer cover layer and a low-melting grade of elastomer is used in the inner cover layer. The cover stocks of high specific gravity are used so that the difference between the specific gravity of the center ball and the specific gravity of the cover is only 0.2 or less. These measures increase the moment of inertia and reduce the spin attenuation of the golf ball, thereby increasing the distance.

In addition, the inventors have found that using a low-melting thermoplastic polyurethane elastomer having a melting point of 80 to 110° C. in the inner cover layer assures amalgamation of the cover stock with the rubber thread layer during molding and enables fusion of the inner cover layer with the outer cover layer, thus achieving durability. When the thermoplastic polyurethane elastomer used in the outer cover layer has a melting point of 110 to 165° C., golf balls of excellent carry and moldability can be obtained.

BRIEF DESCRIPTION OF THE DRAWING

The objects, features and advantages of the invention will become more apparent from the following detailed description when read in connection with the accompanying diagram.

DETAILED DESCRIPTION OF THE INVENTION

Figure 1:
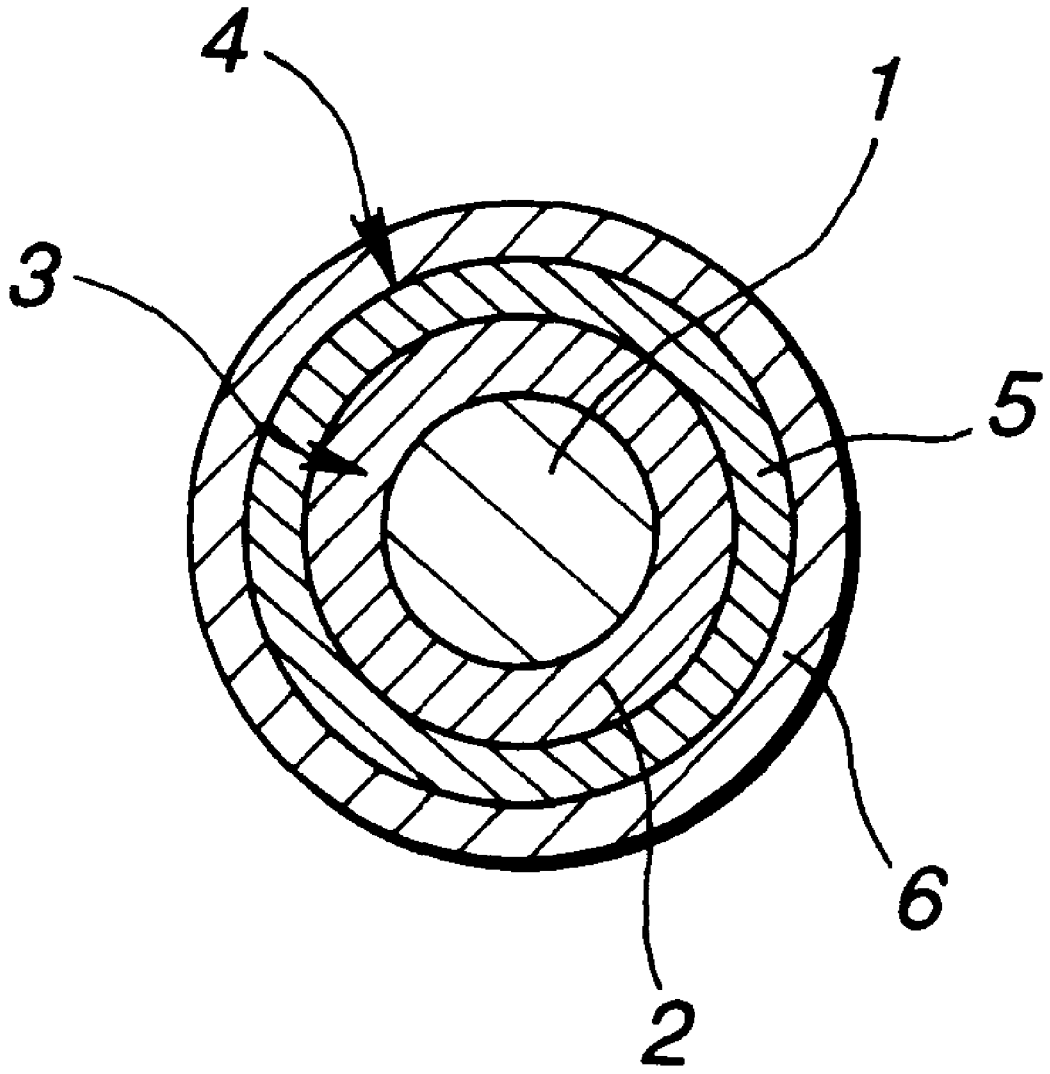
FIG. 1 is a cross-sectional view of a wound golf ball according to the present invention.

Referring to FIG. 1, the thread-wound golf ball according to the invention is comprised of a wound core 3 made up of a center ball 1 and a layer of rubber thread 2 formed thereon, and a cover 4 enclosing the wound core 3. The cover 4 has a multilayer structure consisting essentially of an inner cover layer 5 and an outer cover layer 6. High-specific-gravity thermoplastic polyurethane elastomers are used as the main components of the respective cover resins for the inner and outer cover layers 5 and 6. The melting point of the thermoplastic polyurethane elastomer used in the inner cover layer 5, the thickness of the inner cover layer 5, the Shore D hardness and thickness of the outer cover layer 6, and the overall thickness of the cover 4 have been optimized.

To assure that the surface of the golf ball has yellowing resistance, aliphatic and/or alicyclic diisocyanate-based thermoplastic polyurethane elastomers are used as the thermoplastic polyurethane elastomers serving as the main components of the cover resins.

This thermoplastic polyurethane elastomer has a molecular structure consisting of a high molecular weight polyol compound as soft segments, a molecular chain extender as hard segments, and a diisocyanate.

The high molecular weight polyol compounds include, without particular limitation, polyester polyols, polycarbonate polyols and polyether polyols. Suitable polyester polyols include polycaprolactone glycol, poly(ethylene-1,4-adipate) glycol, poly(butylene-1,4-adipate) glycol and poly (diethylene glycol adipate) glycol. A suitable polycarbonate polyol is (hexanediol-1,6-carbonate) glycol, and a suitable polyether polyol is polyoxytetramethylene glycol. The number-average molecular weight of these polymeric polyols is preferably about 600 to 5,000, and more preferably about 1,000 to 3,000.

Chain extenders that may be used include, without particular limitation, conventional polyhydric alcohols and amines. Suitable examples include 1,4-butylene glycol, 1,2-ethylene glycol, 1,3-propylene glycol, 1,6-hexylene glycol, 1,3-butylene glycol, dicyclohexylmethanediamine (hydrogenated MDA), and isophoronediamine (IPDA). The number-average molecular weight of these is preferably about 200 to 15,000.

To provide the cover with yellowing resistance, use is made of an aliphatic or an alicyclic diisocyanate as the diisocyanate component. Suitable examples include such aliphatic diisocyanates as hexamethylene diisocyanate (HDI), 2,2,4- and 2,4,4-trimethylhexamethylene diisocyanate (TMDI), and lysine diisocyanate (LDI); and such alicyclic diisocyanates as dicyclohexyl diisocyanate ($H_{12}$MDI). It is most preferable to use hexamethylene diisocyanate (HDI) in the outer cover layer, and to use dicyclohexyl diisocyanate ($H_{12}$MDI) with a low melting point in the inner cover layer.

Illustrative examples of thermoplastic polyurethane elastomers for the outer layer cover stock include those having the trade names Pandex T-R3080 and T-7890, both manufactured by Dainippon Ink & Chemicals, Inc. Illustrative examples of thermoplastic polyurethane elastomers for the inner layer cover stock which satisfy the melting point requirements described later in this specification include those available under the sample names Pandex EX-PE60D, EX-PE90A and EX-PE85A from Dainippon Ink & Chemicals, Inc.

Other thermoplastic resins may be blended as suitable in the above thermoplastic polyurethane elastomers. Examples of these other thermoplastic resins include polyamide elastomers, polyester elastomers, ionomers, styrene block elastomers, hydrogenated butadiene, ethylene-vinyl acetate copolymers (EVA), polycarbonates and polyacrylates.

Along with the above resin ingredients, various additives such as pigments, dispersants, antioxidants, ultraviolet absorbers and parting agents may be added to the cover stock in conventional amounts if necessary.

According to the invention, the above-described components may be suitably selected and used respectively in the inner cover layer 5 and outer cover layer 6 in combination with the thermoplastic polyurethane elastomers. However, the inner cover layer 5 must be formed of a cover stock which penetrates the rubber thread layer well and is able to enhance the hitting durability and cut resistance of the golf ball, and which also, in the molding step, melts at a temperature which will not degrade the rubber thread, readily penetrates the rubber thread layer, and forms a fusion bond with the outer cover layer 6. To satisfy these requirements, the thermoplastic polyurethane elastomer used as the main component in the inner cover layer should have a melting point of 80 to 110° C., and especially 85 to 110° C., and preferably a melt-flow index of 1 to 15 dg/min at 190° C. When the melting point of the thermoplastic polyurethane elastomer is lower than 80° C., deformation or bursting can arise due to the severe temperature conditions that may occur in ordinary use (such as when golf balls are left in the trunk of an automobile in blazing hot summer weather). A melting point higher than 110° C. requires a high molding temperature to adequately impregnate the rubber thread layer with the cover stock, which causes degradation of the rubber thread, resulting in lower hardness and initial velocity. Also, when the thermoplastic polyurethane elastomer has a melt-flow index of lower than 1 dg/min at 190° C., it may become necessary to increase the melting temperature during molding. On the other hand, when the melt-flow index is higher than 15 dg/min, more elastomer squeezes out than penetrates into the rubber thread layer during molding, resulting in lower hitting durability and cut resistance.

Preferably the inner cover layer has a Shore D hardness of 30 to 60, and especially 30 to 50. When the Shore D hardness is lower than 30, the spin of the ball when hit with a golf club may increase, resulting in a shorter carry. When the Shore D hardness is higher than 60, the layer may lose resilience, failing to acquire a suitable initial velocity.

The specific gravity of the inner cover layer is preferably 1.05 to 1.40, and more preferably 1.05 to 1.30. A specific gravity less than 1.05 may be less effective for increasing the moment of inertia whereas a specific gravity higher than 1.40 may result in a decrease in resilience.

The thickness of the inner cover layer is 0.5 to 2.0 mm, and preferably 0.6 to 1.8 mm. When the thickness is less than 0.5 mm, the depth of penetration into the rubber thread layer is insufficient, which compromises durability and renders unattainable the objects of the invention. On the other hand, a thickness greater than 2.0 mm results in a decreased resilience, failing to acquire a suitable initial velocity.

For the outer cover layer, the thermoplastic polyurethane elastomer used preferably has a melting point of 110 to 165° C., more preferably 120 to 160° C., and especially 120 to 150° C. A melting point lower than 110° C. has some risk that the carry may decrease, whereas a melting point higher than 165° C. has some risk that the moldability may become inferior and rubber thread breakage or degradation may arise during molding.

The outer cover layer has a Shore D hardness of 40 to 55, and preferably 42 to 50. When the Shore D hardness is less than 40, the spin of the ball when hit increases, resulting in a decrease in the carry. On the other hand, when the hardness is higher than 55, the cover tends to mar easily when hit with an iron.

The specific gravity of the outer cover layer is preferably 1.05 to 1.40, and especially 1.05 to 1.30. Below 1.05, the moment of inertia-increasing effect may be too small. Above 1.40, the cover tends to mar easily when hit with an iron.

The thickness of the outer cover layer is 0.5 to 2.0 mm, and preferably 0.6 to 1.8 mm.

The overall thickness of the cover consisting of the inner and outer cover layers is 1.2 to 3.5 mm, and preferably 1.5 to 3.0 mm. The specific gravity of the cover as a whole is preferably 1.05 to 1.40, and especially 1.05 to 1.30.

In the present invention, the center ball may be a solid center or a liquid center, although wound golf balls having a solid center are especially preferable.

When a solid center is used as the center ball, it may be produced by a known method using a known material composed primarily of cis-1,4-polybutadiene. The solid center preferably has an outside diameter of 28 to 36 mm, and especially 30 to 34 mm. Advantageous use can be made of a solid center having a hardness corresponding to a distortion of 1.5 to 4.5 mm, more preferably 1.8 to 4.0 mm under a load of 30 kg. Moreover, the weight may be suitably selected without any particular limitation, although the weight is generally 15 to 30 grams, and preferably 17 to 28 grams. The resilience of the solid center should preferably be such that the rebound height when dropped from a height of 120 cm is at least 95 cm, and more preferably 97 to 104 cm.

When the center ball is a liquid center, it may be produced by a conventional method. For example, the liquid center may be obtained by filling a rubber center bag with a liquid. In this case, the liquid center preferably has an outside diameter of 28 to 32 mm, and especially 29 to 31 mm. Preferably the center bag itself has a gage of 1.5 to 3 mm, and a JIS-A hardness of from 45 to 65. Any suitable fill liquid known to the art may be used, and examples include water, sodium sulfate solutions, and pastes obtained by blending zinc oxide or barium sulfate with water.

In the present invention, the specific gravity of the center ball may be the same as or higher than the specific gravity of the cover. It is recommended that the difference between the specific gravity of the center ball and the specific gravity of the cover be no more than 0.2, and especially from 0 to 0.15. A difference in specific gravity of greater than 0.2 may fail to achieve a sufficient moment of inertia-increasing effect and, in turn, an increased carry.

The rubber thread layer 2 is formed by winding rubber thread in a highly extended state around the outside of the center ball 1 described above. A conventional thread winding method may be employed for this purpose, and the rubber thread used may be a material familiar to the art. No particular limits are imposed on the specific gravity, width, thickness and other characteristics of the rubber thread, although use is generally made of rubber thread having a specific gravity of 0.93 to 1.1, and especially 0.93 to 1, a width of 1.4 to 2 mm, and especially 1.5 to 1.7 mm, and a thickness of 0.3 to 0.7 mm, and especially 0.4 to 0.6 mm.

The method of covering the inner and outer cover layers may be conducted in the conventional manner as in the use of an ionomer resin cover stock. For example, Hemispherical half-cups of the inner layer and outer layer cover stocks are formed and mated in pairs to cover the wound core therewith, followed by molding at 140 to 180° C. for 2 to 10 minutes under pressure. The method of covering the wound core with a pair of hemispherical half-cups of the inner layer cover stock to mold under heat and pressure and then injection molding the outer layer cover stock thereto may also be employed.

As with conventional golf balls, the wound golf balls of the invention have numerous dimples formed on the surface. The dimple parameters and arrangement may be optimized to further increase the moment of inertia and thereby improve the flight characteristics.

Thus, dimples may be provided such that, if the golf ball is considered to be a smooth sphere, the ratio of the surface area of this hypothetical sphere surrounded by the edges of the individual dimples to the entire surface area of the hypothetical sphere is at least 65%, and preferably 70 to 80%. When the percent dimple surface area is less than 65%, it may not be possible to obtain the outstanding flight characteristics, and especially the increased carry, that are described above.

Moreover, the percent dimple volume may be set at 0.76 to 1%, and preferably 0.78 to 0.94%. The percent dimple volume is (total dimple volume)/(ball volume)×100 wherein "ball volume" refers to the volume of the true spherical ball when one imagines the surface of the golf ball to be free of dimples, and "total dimple volume" refers to the sum of the volumes of the individual dimples. When the percent dimple volume is less than 0.76%, the ball may travel a too high trajectory, resulting in a shorter carry. When the dimple volume ratio is greater than 1%, the trajectory may become too low, similarly resulting in a shorter carry.

The number of dimples is preferably from 350 to 500, more preferably from 370 to 480, and most preferably from 390 to 450. When the number of dimples is less than 350, the diameter of a dimple becomes too large, resulting in a decrease in the true sphericity of the ball. When the ball has more than 500 dimples, the diameter of a dimple becomes so small that the aerodynamic effect of dimples essentially vanishes. No limits are imposed on the diameter, depth and cross-sectional shape of dimples, although the diameter may generally be set within a range of 1.4 to 2.2 mm and the depth may generally be set within a range of 0.15 to 0.25 mm. Two or more types of dimples having different diameters, depths and the like may be formed. Nor are there any particular limits on the manner in which the dimples are arranged. For example, known arrangements such as regular octahedral, regular dodecahedral and regular icosahedral arrangements may be employed. Moreover, any of various patterns such as square, hexagonal, pentagonal and triangular patterns may be formed on the ball surface by the dimple arrangement.

The inventive wound golf balls constructed as described above preferably have a ball hardness corresponding to a distortion of 2.4 to 3.6 mm, and especially 2.6 to 3.4 mm under a load of 100 kg.

Golf tournaments are conducted under the same rules and regulations throughout the world. The golf balls of the present invention must, as a matter of course, accord with golf regulations relating to weight, diameter, symmetry and initial velocity. Thus, the weight may be suitably set at not greater than 45.93 g, the diameter at not less than 42.67 mm, and the initial velocity at not greater than 76.2 m/s when measured with an R&A-approved apparatus (a maximum tolerance of 2%, 77.7 m/s; the temperature of ball when tested, 23±1° C.).

Because the wound golf ball according to the second embodiment of this invention possesses a cover consisting essentially of inner and outer layers that have been optimized using specific diisocyanate-based thermoplastic polyurethane elastomers as the main ingredients therein, it is a high performance, high-quality golf ball having not only a better carry owing to the increased moment of inertia, but also excellent control, scuff resistance when hit with an iron, yellowing resistance and moldability.

EXAMPLE

Examples of the invention are given below by way of illustration, and are not intended to limit the invention. All parts are by weight.

Examples 1–3 and Comparative Examples 1–4

The solid center compositions shown in Table 1 were kneaded, then molded and vulcanized at 155° C. for 15 minutes in a mold, thereby obtaining three types of solid centers (A to C).

The diameter, weight, specific gravity and hardness (expressed by a distortion under a load of 30 kg) for each of the resulting center balls were measured. The results are shown in Table 1.

TABLE 1

| | Center ball | A | B | C |
|---|---|---|---|---|
| Blended amounts (parts by weight) | cis-1,4-Polybutadiene rubber | 100 | 100 | 100 |
| | Zinc acrylate | 20.0 | 20.0 | 20.0 |
| | Zinc oxide | 22.0 | 27.0 | 24.0 |
| | Barium sulfate | 22.0 | 27.0 | 24.0 |
| | Dicumyl peroxide | 1.2 | 1.2 | 1.2 |
| After vulcanization | Diameter (mm) | 31.9 | 32.0 | 31.9 |
| | Weight (g) | 21.9 | 23.1 | 22.3 |
| | Specific gravity | 1.28 | 1.35 | 1.30 |
| | Hardness (mm) | 1.95 | 1.91 | 1.95 |

Rubber thread of the following formulation was wound onto the solid centers by a conventional winding method to give wound cores.

| Rubber Thread Composition and Dimensions | |
|---|---|
| Polyisoprene rubber | 70 parts |
| Natural rubber | 30 parts |
| Zinc oxide | 1.5 parts |
| Stearic acid | 1 part |
| Vulcanizing accelerator | 1.5 parts |
| Sulfur | 1 part |
| Specific gravity: | 0.93 |
| Rubber thread dimensions: | width 1.55 mm, thickness 0.55 mm |

Next, the cover ingredients shown in Table 2 were kneaded to give cover compositions A to E. Hemispherical half-cups were molded from these cover compositions. The half-cups of the inner layer and outer layer cover stocks were mated in pairs in the combinations shown in Table 3.

TABLE 2

| Type of dispersion | | A | B | C | D | E |
|---|---|---|---|---|---|---|
| Blended amounts (parts by weight) | Pandex[1] T-7890 | 100 | | | | |
| | Pandex[1] EX-PE60D | | 100 | | | |
| | Pandex[1] Ex-PE90A | | | 100 | | |
| | Pandex[1] EX-PE85A | | | | 100 | |
| | Himilan[2] 1706 | | | | | 50 |
| | Himilan[2] 1605 | | | | | 50 |
| | Titanium oxide | 5 | 5 | 5 | 5 | 5 |
| | Magnesium stearate | 0.5 | 0.5 | 0.5 | 0.5 | 0.5 |
| Specific gravity | | 1.21 | 1.13 | 1.12 | 1.09 | 0.97 |
| Shore D hardness | | 42 | 56 | 39 | 32 | 62 |
| Melting point (° C.)[3] | | 128 | 85 | 100 | 92 | 90 |
| Melt-flow rate (g/min, 190° C.) | | 5.7 | 7.5 | 13.9 | 5.3 | 1.8 |

[1]Pandex: A non-yellowing thermoplastic polyurethane elastomer (Dainippon Ink & Chemicals, Inc.)
[2]Himilan: An ionomer resin (DuPont-Mitsui Polychemicals Co., Ltd.).
[3]The melting point was measured with a differential scanning calorimeter DSC 8230L (manufactured by Rigaku Denki K.K.) at a heating rate of 10° C./min.

These half-cups and the wound cores A to C were assembled in the combinations shown in Table 3 and molded under applied heat and pressure for 5 minutes at the temperature settings indicated in Table 3, thereby obtaining the wound golf balls of Examples 1 to 3 and Comparative Examples 1 to 4.

At the same time as thermocompression molding, dimples were formed on the surfaces of the resulting balls. The number of dimples was 396 (in three sizes), the percent dimple surface area was 76%, and the percent dimple volume was 0.92%.

The resulting golf balls were evaluated by the test methods described below. The results are shown in Table 3.

Ball Hardness

A load of 100 kg was applied to the ball, and the amount of deformation (mm) was measured. A larger numerical value indicates a softer ball.

Flight Test

Using a swing robot machine, the spin rate, initial velocity, angle of elevation, carry, and total distance were measured when the ball was hit with a driver (W#1) at a head speed of 45 m/s (HS=45).

Durability Index

Ten golf balls of each type were repeatedly shot 200 times against an impact plate at a head speed of 45 m/s. The number of balls in each case that showed no deformation or cracking was expressed relative to a value of 100 for the balls in Example 1.

TABLE 3

| | | Examples of Invention | | | Comparative Examples | | | |
|---|---|---|---|---|---|---|---|---|
| | | 1 | 2 | 3 | 1 | 2 | 3 | 4 |
| Center | Formulation | A | A | A | A | B | C | C |
| | Specific gravity | 1.28 | 1.28 | 1.28 | 1.28 | 1.35 | 1.30 | 1.30 |
| Inner | Formulation | B | C | D | A | E | B | D |
| cover | Specific gravity | 1.13 | 1.12 | 1.09 | 1.21 | 0.97 | 1.13 | 1.09 |
| layer | Shore D hardness | 56 | 39 | 32 | 42 | 62 | 56 | 32 |
| | Thickness (mm) | 0.9 | 0.9 | 0.9 | 0.9 | 0.9 | 0.9 | 0.9 |
| | Melting point (° C.) | 85 | 100 | 92 | 128 | 90 | 85 | 92 |
| Outer | Formulation | A | A | A | A | A | B | D |
| cover | Specific gravity | 1.21 | 1.21 | 1.21 | 1.21 | 1.21 | 1.13 | 1.09 |
| layer | Shore D hardness | 42 | 42 | 42 | 42 | 42 | 56 | 32 |
| | Thickness (mm) | 0.9 | 0.9 | 0.9 | 0.9 | 0.9 | 0.9 | 0.9 |
| | Melting point (° C.) | 128 | 128 | 128 | 128 | 128 | 85 | 92 |
| Molding | Temperature (° C.) | 145 | 145 | 145 | 165 | 145 | 140 | 140 |
| Ball | Diameter (mm) | 42.68 | 42.67 | 42.67 | 42.70 | 42.69 | 42.67 | 42.67 |
| | Weight (g) | 45.2 | 45.1 | 45.0 | 45.3 | 45.2 | 45.3 | 45.1 |
| | Hardness (mm) | 2.81 | 2.85 | 2.83 | 2.95 | 2.88 | 2.75 | 2.85 |
| W#1 | Spin (rpm) | 2800 | 2800 | 2850 | 2750 | 2750 | 2660 | 3000 |
| HS = 45 | Initial velocity (m/s) | 65.3 | 65.5 | 65.6 | 65.0 | 65.1 | 64.2 | 65.5 |
| | Angle of elevation (°) | 12.0 | 12.1 | 12.1 | 11.8 | 11.9 | 11.5 | 12.5 |
| | Carry (m) | 205.8 | 206.5 | 206.8 | 203.1 | 203.9 | 201.1 | 207.6 |
| | Total distance (m) | 215.6 | 216.4 | 216.7 | 212.6 | 215.0 | 211.0 | 213.0 |
| Durability index | | 100 | 100 | 100 | 75 | 10 | 95 | 100 |

It is apparent from the results in Table 3 that the wound golf balls of the present invention have excellent carry, spin performance, and durability because the inner and outer cover layers have been optimized. Moreover, the whiteness of the ball is assured by the use of an aliphatic diisocyanate-based thermoplastic polyurethane elastomer as the main ingredient in the cover stock. By contrast, in wound golf balls in which the cover has been given a two-layer structure using the same resin (Comparative Examples 1, 3 and 4), a non-yellowing thermoplastic polyurethane elastomer is employed as the main ingredient in the cover stock, but a sufficient carry is not obtained. In particular, the golf balls of Comparative Examples 1 and 2 in which only the outer cover layer was formed of the same cover stock as that used in the corresponding cover layer in Examples 1 to 3 of the invention had a durability to repeated hitting which was inferior to that of the golf balls according to the invention. Moreover, the golf balls having inner and outer cover layers in which an ionomer resin was used as the inner layer cover stock (Comparative Example 2) can be seen to have a vastly inferior durability, in spite of having the same outer cover layer as the golf balls according to the invention.

Although some preferred embodiments have been described, many modifications and variations may be made thereto in light of the above teachings. It is therefore to be understood that the invention may be practiced otherwise than as specifically described without departing from the scope of the appended claims.

We claim:

1. A thread-wound golf ball comprising;

a wound core composed of a center ball and a layer of rubber thread wound onto the center ball and a cover with a multilayer structure having an inner layer and an outer layer that has been formed over said core, wherein said inner cover layer and said outer cover layer are each composed primarily of a thermoplastic polyurethane elastomer of an aliphatic and/or alicyclic diisocyanate, said inner cover layer having a melting point in the range of 80 to 110° C. and a thickness in the range of 0.5 to 2.0 mm, said outer cover layer having a melting point in the range of 120 to 165° C., a Shore D hardness in the range of 40 to 55 and a thickness in the range of 0.5 to 2.0 mm, and the cover has an overall thickness in the range of 1.2 to 3.5 mm.

2. The thread-wound golf ball of claim 1 wherein said center ball is a solid center having a weight in the range of 15 to 30 grams and composed primarily of c15-1, 4-polybutadiene.

3. The thread-wound golf ball of claim 1 wherein the center ball is a solid center having a diameter of 28 to 36 mm and a distortion of 1.5 to 4.5 mm under a load of 30 kg.

4. The thread-wound golf ball of claim 1 wherein said layer of rubber thread wound comprises a rubber thread having a specific gravity in the range of 0.93 to 1.1, a width in the range of 1.4 to 2.0 mm and a thickness in the range of 0.3 to 0.7 mm.

5. The thread-wound golf ball of claim 1 wherein said inner cover layer has a melt-flow index of 1 to 15 dg/min at 190° C.

6. The thread-wound golf ball of claim 1 wherein said inner cover layer has a melting point in the range of 85 to 110° C.

7. The thread-wound golf ball of claim 1 wherein said inner cover layer has a Shore D hardness in the range of 30 to 60.

8. The thread-wound golf ball of claim 1 wherein said inner cover layer has a specific gravity in the range of 1.05 to 1.40 and said outer cover has a specific gravity in the range of 1.05 to 1.40.

9. The thread-would golf ball of claim 8 wherein the specific gravity of said inner and outer cover layers is in the range of 1.05 to 1.30.

10. The thread would golf ball of claim 1 wherein said inner cover layer has a Shore D hardness in the range of 30 to 50 and said outer cover layer has Shore D hardness in the range of 42 to 50.

11. The thread-wound golf ball of claim 1 wherein the thickness of said inner cover layer is in the range of 0.6 to 1.8 mm.

12. The thread-wound golf ball of claim 1 wherein the thickness of said outer cover layer is in the range of 0.6 to 1.8 mm.

13. The thread-wound golf ball of claim 1 wherein said cover has an overall thickness in the range of 1.5 to 3.0 mm and a specific gravity in the range of 1.05 to 1.30.

14. The thread-wound golf ball of claim 1 wherein said center ball is a solid center having an outside diameter in the range of 30 to 34 mm.

15. The thread-wound golf ball of claim 1 wherein said center ball his a liquid center having an outside diameter in the range of 28 to 32 mm.

16. The thread-wound golf ball of claim 1 wherein the specific gravity of center ball is the same or higher than the specific gravity of said cover and any difference is no greater than 0.2.

* * * * *